US009234403B2

(12) United States Patent
Lehr et al.

(10) Patent No.: US 9,234,403 B2
(45) Date of Patent: Jan. 12, 2016

(54) DOWNHOLE ASSEMBLY

(71) Applicants: Joerg Lehr, Celle (DE); Ines Rex, Lehrte-Arpke (DE); Detlev Benedict, Celle (DE)

(72) Inventors: Joerg Lehr, Celle (DE); Ines Rex, Lehrte-Arpke (DE); Detlev Benedict, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 427 days.

(21) Appl. No.: 13/755,276

(22) Filed: Jan. 31, 2013

(65) Prior Publication Data

US 2014/0209293 A1 Jul. 31, 2014

(51) Int. Cl.

| | |
|---|---|
| ***E21B 33/128*** | (2006.01) |
| ***E21B 33/129*** | (2006.01) |
| ***E21B 33/12*** | (2006.01) |
| *E21B 33/00* | (2006.01) |

(52) U.S. Cl.

CPC ..... *E21B 33/128* (2013.01); *E21B 33/1208* (2013.01); *E21B 33/129* (2013.01); *E21B 2033/005* (2013.01)

(58) Field of Classification Search

CPC E21B 33/129; E21B 33/128; E21B 2033/005
See application file for complete search history.

(56) References Cited

U.S. PATENT DOCUMENTS

| | | | | |
|---|---|---|---|---|
| 2,797,759 | A * | 7/1957 | Long et al. | 277/342 |
| 5,906,240 | A | 5/1999 | Kilgore et al. | |
| 6,513,600 | B2 * | 2/2003 | Ross | 166/387 |
| 7,178,601 | B2 * | 2/2007 | Burge | 166/380 |
| 7,273,110 | B2 * | 9/2007 | Pedersen et al. | 166/387 |
| 7,673,692 | B2 | 3/2010 | Kunz | |
| 7,743,825 | B2 | 6/2010 | O'Malley et al. | |
| 7,874,354 | B2 | 1/2011 | Freyer | |
| 2005/0000697 | A1 * | 1/2005 | Abercrombie Simpson et al. | 166/380 |
| 2007/0068671 | A1 * | 3/2007 | Lohbeck | 166/207 |
| 2010/0294485 | A1 | 11/2010 | Lynde | |
| 2011/0036561 | A1 | 2/2011 | Bishop et al. | |
| 2011/0147013 | A1 | 6/2011 | Kilgore | |
| 2014/0076539 | A1 * | 3/2014 | Hiorth | 166/192 |

FOREIGN PATENT DOCUMENTS

EP 0528327 A2 2/1993

OTHER PUBLICATIONS

Notification of Transmittal of the International Search Report and the Written Opinion of the International Searching Authority, or the Declaration; PCT/US2013/078220; Apr. 22, 2014, 14 pages.

Baker Hughes, "TORXS Expandable Liner Hanger System" Liner Systems, www.bakerhughes.com/torxs, 2010 Baker Hughes Incorporated, 2 pages.

* cited by examiner

*Primary Examiner* — David Bagnell
*Assistant Examiner* — Michael Goodwin
(74) *Attorney, Agent, or Firm* — Cantor Colburn LLP

(57) ABSTRACT

A downhole assembly includes a wave seal packer including a wave portion having a wave form shape in an un-expanded condition. The wave portion configured to radially encircle a tubular with alternating and interconnected uphole and downhole portions. The packer having a substantially uniform internal radius in the un-expanded condition.

23 Claims, 8 Drawing Sheets

DOWNHOLE ASSEMBLY

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A liner is a tubular member that is usually run inside of a borehole casing of the borehole and suspended within the casing. Liner packers and liner hangers are commonly used together to seal the liner to the outer casing. The liner hanger acts as an anchor during the process of setting the packer seals. Mechanically or hydraulically set slips of the liner hanger are used to effectively interconnect the liner hanger to the casing. As the slips move radially outwardly, the toothed surfaces of the slips bitingly engage the inner wall surface of the casing.

Typical liner packer seals incorporate elastomers at the seal interface. The material selected for the packer seal must take into consideration the caustic fluids, high temperatures and high pressures that are encountered in a downhole environment so as to prevent premature seal degradation. In addition, as time, manpower requirements, and mechanical maintenance issues are all variable factors that can significantly influence the cost effectiveness and productivity of a downhole operation, the art would be receptive to improved apparatus and methods for increasing the rate of expansion of a liner packer without deleteriously affecting the sustainability of the liner packer in the downhole environment.

BRIEF DESCRIPTION

A downhole assembly includes a wave seal packer including a wave portion having a wave form shape in an un-expanded condition, the wave portion configured to radially encircle a tubular with alternating and interconnected uphole and downhole portions, the packer having a substantially uniform internal radius in the un-expanded condition.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
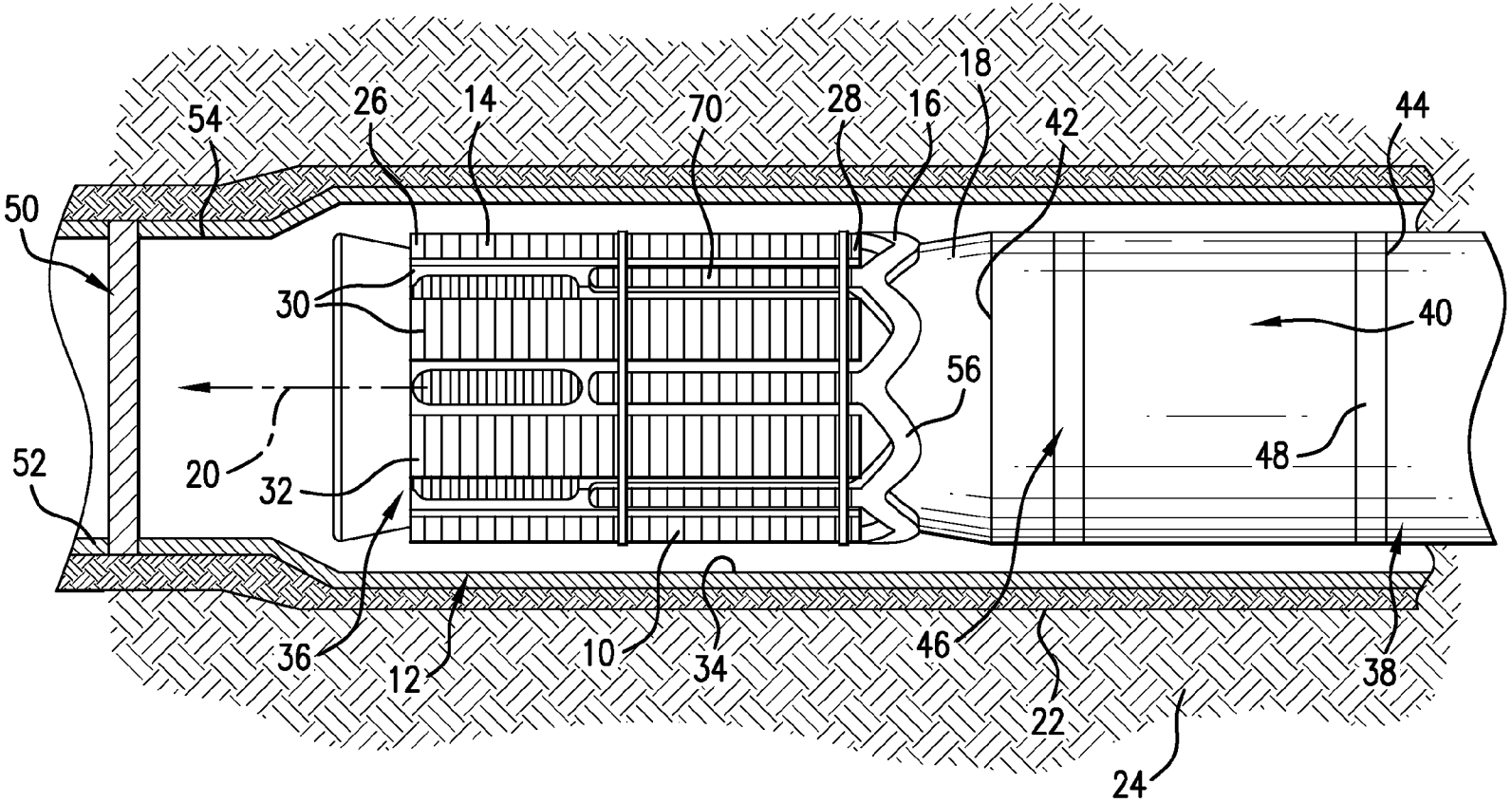
FIG. 1 shows a side plan view of an exemplary embodiment of a liner hanger assembly within a cross-sectional view of a borehole casing.
Figure 2:
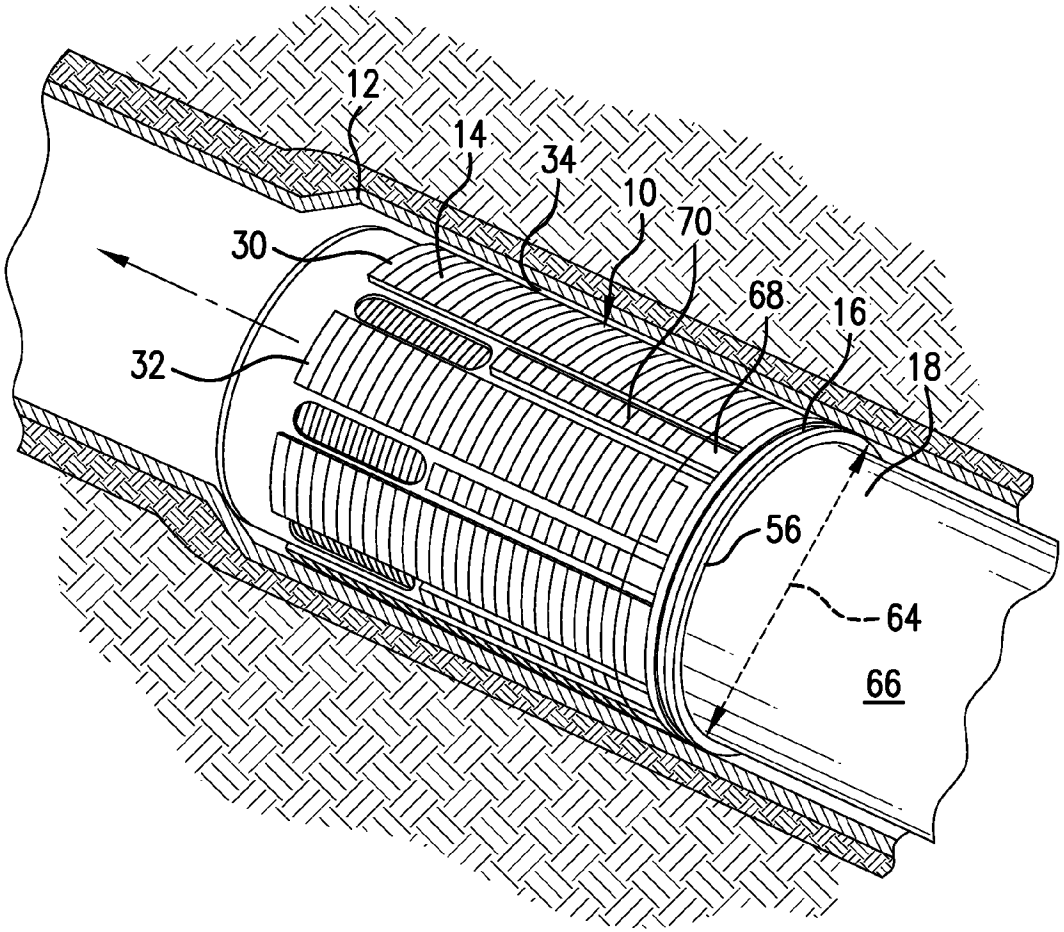
FIG. 2 shows a side perspective view of the liner hanger assembly of FIG. 1 in an expanded condition within a cross-sectional view of a borehole casing.

With reference to FIGS. 1-2, an exemplary embodiment of a downhole assembly 10, usable as a liner hanger assembly, is depicted within a casing 12 and includes a liner hanger 14 and a liner hanger packer 16 surrounding a tubular 18 such as a liner. A longitudinal axis 20 of the liner hanger assembly 10 is further shown in FIG. 1, and the liner hanger assembly 10 is depicted in FIG. 1 in an un-expanded condition while FIG. 2 shows the liner hanger assembly 10 in an expanded condition. The liner hanger assembly 10 and casing 12 are positioned within a borehole 22 within a formation 24. The liner hanger 14 includes an uphole end 26 and a downhole end 28. The liner hanger 14 further includes a plurality of axially extending columns 30 of slips 32, and each column 30 includes a plurality of slips 32. The term "slips" is used herein to donate any toothed, wedged, or alternative gripping configuration. The columns 30 of slips 32 are illustrated as extending substantially parallel to the longitudinal axis 20 of the liner hanger assembly 10. In the expanded condition shown in FIG. 2, the slips 32 engage with an interior surface 34 of the casing 12 to hold the tubular 18 to the casing 12. Further included within the liner hanger assembly 10 is the liner hanger packer 16, described herein as a wave seal packer. In order to expand the liner hanger assembly 10, a swage mechanism, hydraulics, or the like are used to force an interior of the tubular 18 radially outwardly to compress the liner hanger 14 between the tubular 18 and casing 12. A two-stage process may be used to selectively expand the liner hanger 14 and then the packer 16, such as when premature expansion of the packer 16 is to be prevented.

The wave seal packer 16, as will be further described below, advantageously enables a higher rate of expansion as compared to standard circular shaped packers. In order to take advantage of the higher rate of expansion of the liner hanger assembly 10 having the wave seal packer 16, a first portion or mandrel 36 of the tubular 18, which supports the liner hanger 14 and packer 16, is formed from a material having a high rate of expansion, such as but not limited to a stainless steel material. Downhole of the mandrel 36, a second portion 38 of the tubular 18 is formed from a material having a standard rate of expansion that is less than the rate of expansion of the mandrel 36. An exemplary material of the second portion 38 of the tubular 18 is carbon steel, although other materials having a lower rate of expansion than the mandrel 36 may be employed. In one exemplary embodiment (not shown) the mandrel 36 and the second portion 38 of the tubular 18 are welded directly together. Alternatively, to avoid corrosion that may occur when directly connecting stainless steel material to carbon steel material, and to improve the weld quality and expandability there between, a third portion 40 is disposed as an intermediate spacer of the tubular 18 as shown in FIG. 1 and is welded to a downhole end 42 of the mandrel 36 and an uphole end 44 of the second portion 38 of the tubular 18. The third portion 40 has a higher or same rate of expansion than/as the second portion 38 of the tubular 18, but a lower or same rate of expansion than/as the mandrel 36. The third portion 40 may include materials such as but not limited to titanium and a composite nano material. Alternatively, if the mandrel 36 is made of material X and the second portion 38 is made of material Y, then the material of the third portion 40 may be made of a composite XY. For example, the composite could include 50% X and 50% Y throughout the third portion 40, or the third portion 40 may exhibit a change in composition over the length of the third portion 40 such as 100% X and 0% Y adjacent the downhole end 42 of the mandrel 36, 50% X and 50% Y at a middle section of third portion 40, and 0% X and 100% Y adjacent the uphole end 44 of the second portion 38. In any of the above-described embodiments, the third portion 40 is provided to improve weld quality and expandability to the mandrel 36 relative to the second portion 38 of the tubular 18. The mandrel 36 is welded to the third portion 40 via a first welding seam 46, and the third portion 40 is welded to the second portion 38 via a second welding seam 48. A third welding seam 50 is shown between an uphole segment 52 of the casing 12 having a standard rate of expansion and a downhole segment 54 of the casing having a higher rate of expansion than the uphole segment 52 of the casing 12. The downhole segment 54 of the casing 12 may be formed from the same material as the mandrel 36.

Figure 3:
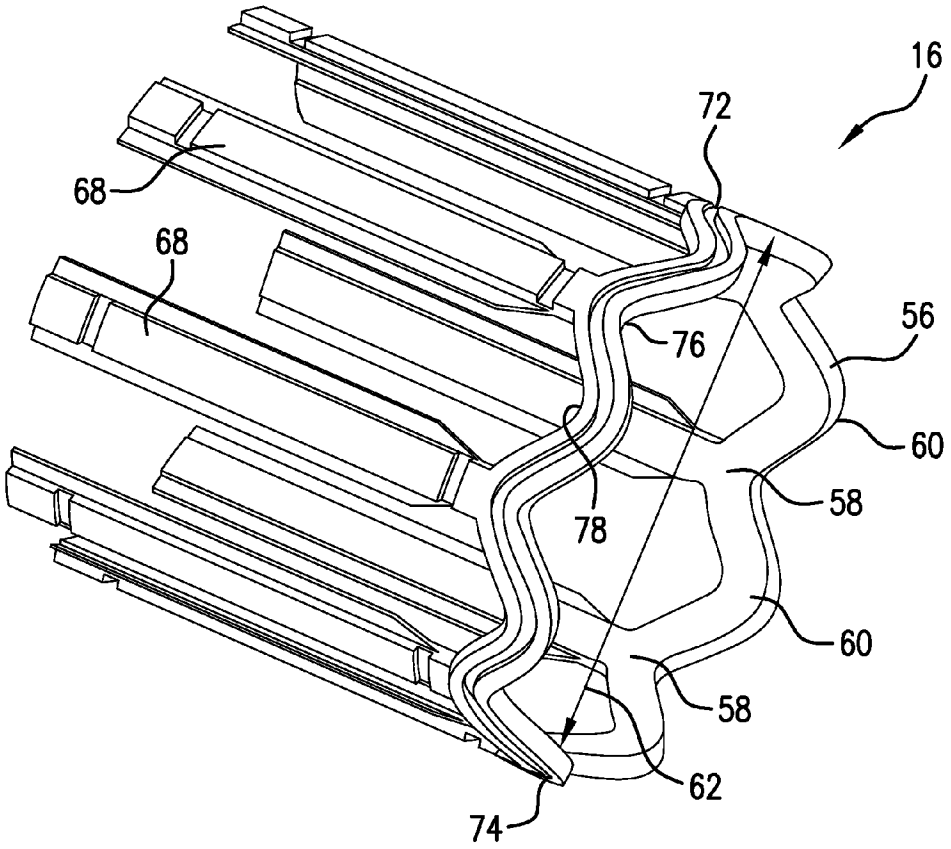
FIG. 3 shows a perspective view of an exemplary embodiment of a liner hanger packer for use in the liner hanger assembly of FIG. 1.

With additional reference now to FIG. 3, the wave seal packer 16 of the liner hanger assembly 10 will be further described. In one exemplary embodiment, the packer includes a wave portion 56 having a waveform shape in an un-expanded condition and a circular shape in an expanded condition (FIG. 2). The packer 16 is configured to radially encircle the tubular 18 to provide the intended sealing function between the tubular 18 and the casing 12. That is, a zone uphole of the packer 16 will be sealed off from a zone downhole of the packer 16 when the packer 16 is in the expanded condition shown in FIG. 2. In the un-expanded condition shown in FIGS. 1 and 3, the wave portion 56 includes alternating and interconnected uphole and downhole portions 58, 60 that may each occupy a discrete radial section of the packer 16. The uphole and downhole portions 58, 60 are arranged to be substantially flush with the liner hanger assembly 10 in both the un-expanded and expanded conditions. In other words, the packer 16 has a substantially uniform inner diameter 62 throughout the wave portion 56 in the un-expanded condition, and a uniform inner diameter 64 in the expanded condition, and the packer 16 lies flat relative to the exterior surface 66 of the tubular 18. As can be readily understood, the inner diameter 64 is greater than the inner diameter 62 due to expansion.

In the exemplary embodiment shown in FIG. 3, the packer 16 further includes a plurality of axially extending fingers 68 extending in an uphole direction from the wave portion 56. In the illustrated embodiment, the fingers 68 extend substantially parallel with the longitudinal axis 20 of the liner hanger assembly 10, the fingers 68 extend from the uphole portions 58 of the wave portion 56, each of the fingers 68 is disposed between adjacent columns 30 of slips 32 of the liner hanger 14, and a number of the fingers 68 is equal to a number of the columns 30. The fingers 68 include a plurality of slips 70 (see FIGS. 1 and 2) disposed, formed or integrated thereon. The fingers 68 aligned within the spaces between the columns 30 of slips 32 assist the packer 16 in maintaining its position within the liner hanger assembly 10, and the slips 70 on the fingers 68 of the packer 16 assist the liner hanger assembly 10 in engaging with the interior surface 34 of the casing 12.

Figure 4:
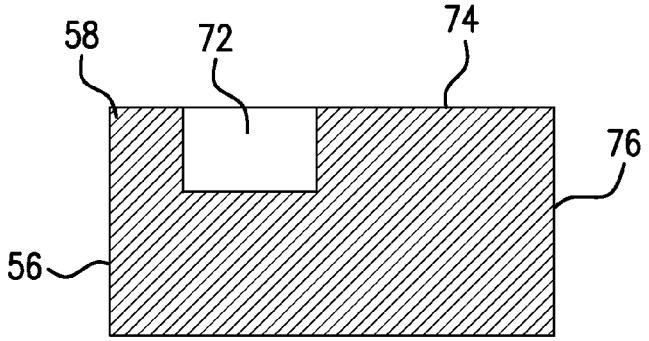
FIGS. 4-6 show cross-sectional views of alternative exemplary embodiments of the liner hanger packer.
Figure 5:
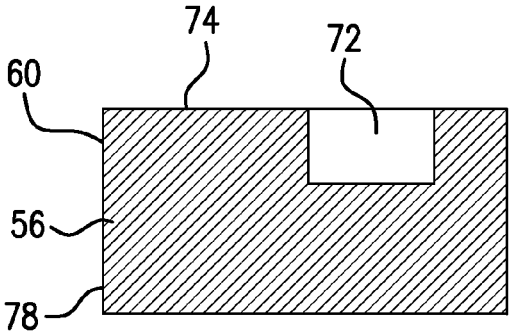
Figure 6:
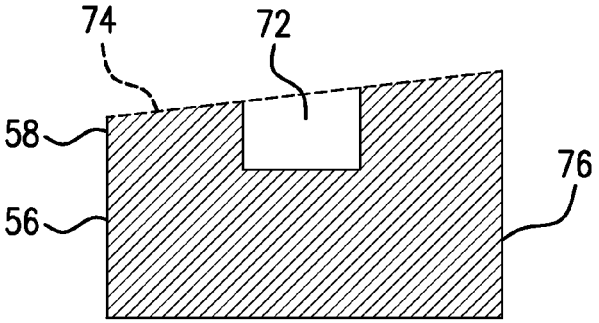

In an exemplary embodiment of the packer 16, the wave portion 56 of the packer 16 further includes a waveform shaped groove 72 within an exterior surface 74 of the wave portion 56. That is, the groove 72 substantially follows the waveform shape of the wave portion 56 in the un-expanded condition, and the groove 72 is substantially circular shaped in the expanded condition. The groove 72 is receptive to an O-ring or alternatively may be filled with an additional sealing material that is connected, vulcanized, or cured within the groove 72 of the wave portion 56. The groove 72 may be centrally located within a width of the wave portion 56 as shown in FIG. 3. With reference to FIGS. 4 and 5, the groove 72 is alternatively offset from the center of the width of the wave portion 56 at the points of the wave portion 56 experiencing the greatest amounts of stress during expansion, including a downhole side 76 of the uphole portions 58 and an uphole side 78 of the downhole portions 60, in order to provide a greater amount of material in the areas experiencing greater stress. With reference to FIG. 6, the wave portion 56 alternatively or additionally includes a greater thickness (height) in the areas (such as side 76) of the wave portion 56 that experience the highest amounts of deformation during expansion.

Figure 7:
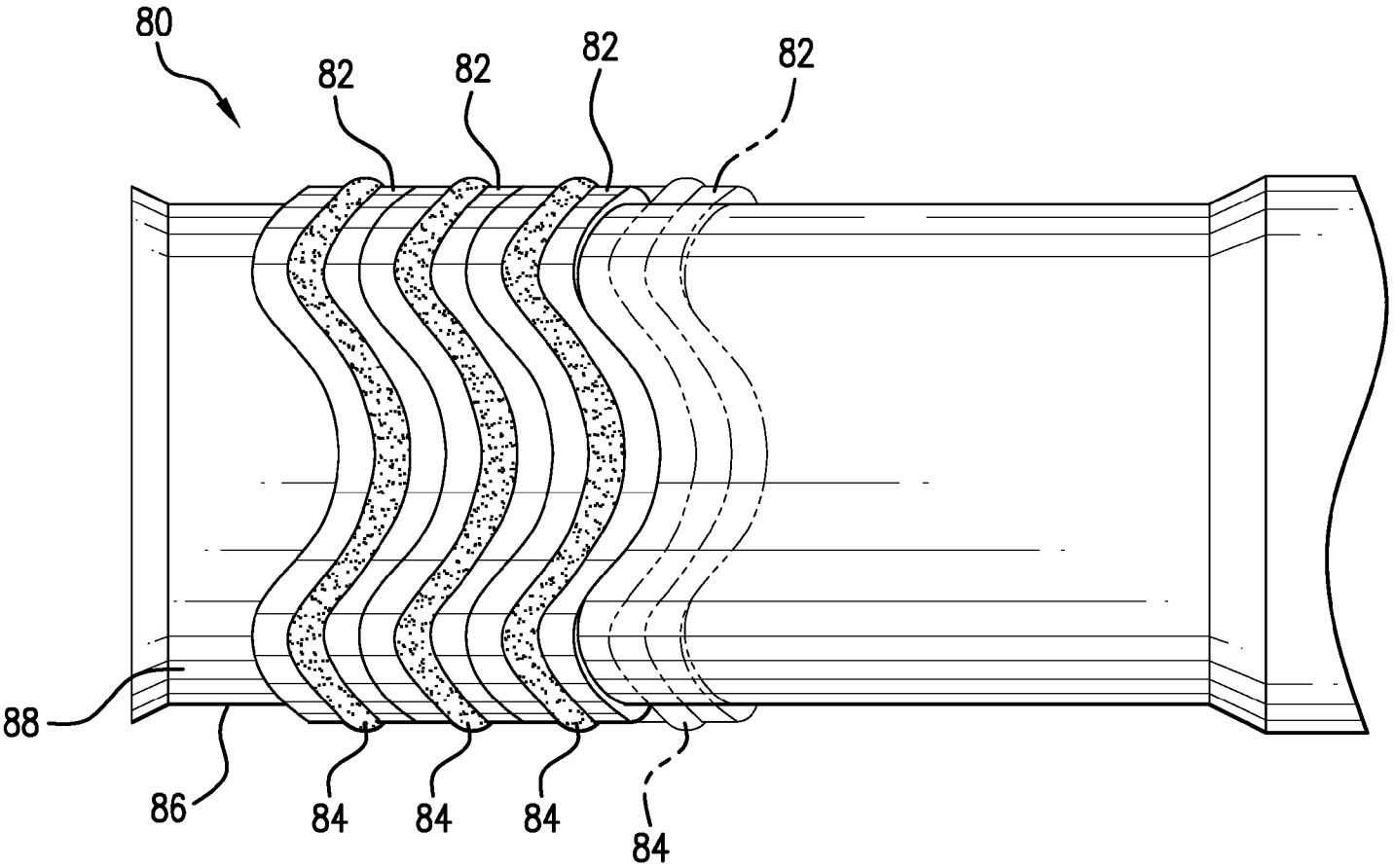
FIG. 7 shows a side plan view of an alternative exemplary embodiment of the liner hanger packer for the liner hanger assembly of FIG. 1.

With reference now to FIG. 7, an alternate exemplary embodiment of a wave seal packer 80 includes a plurality of wave portions 82 and seals 84 disposed thereon. The wave portions 82 are nested together and therefore do not rotate with respect to one another. Also, the wave portions 82 may be mounted within an indented section 86 of a tubular 88 such that the packer 80 is restricted from axial movement within a downhole assembly.

Figure 8:
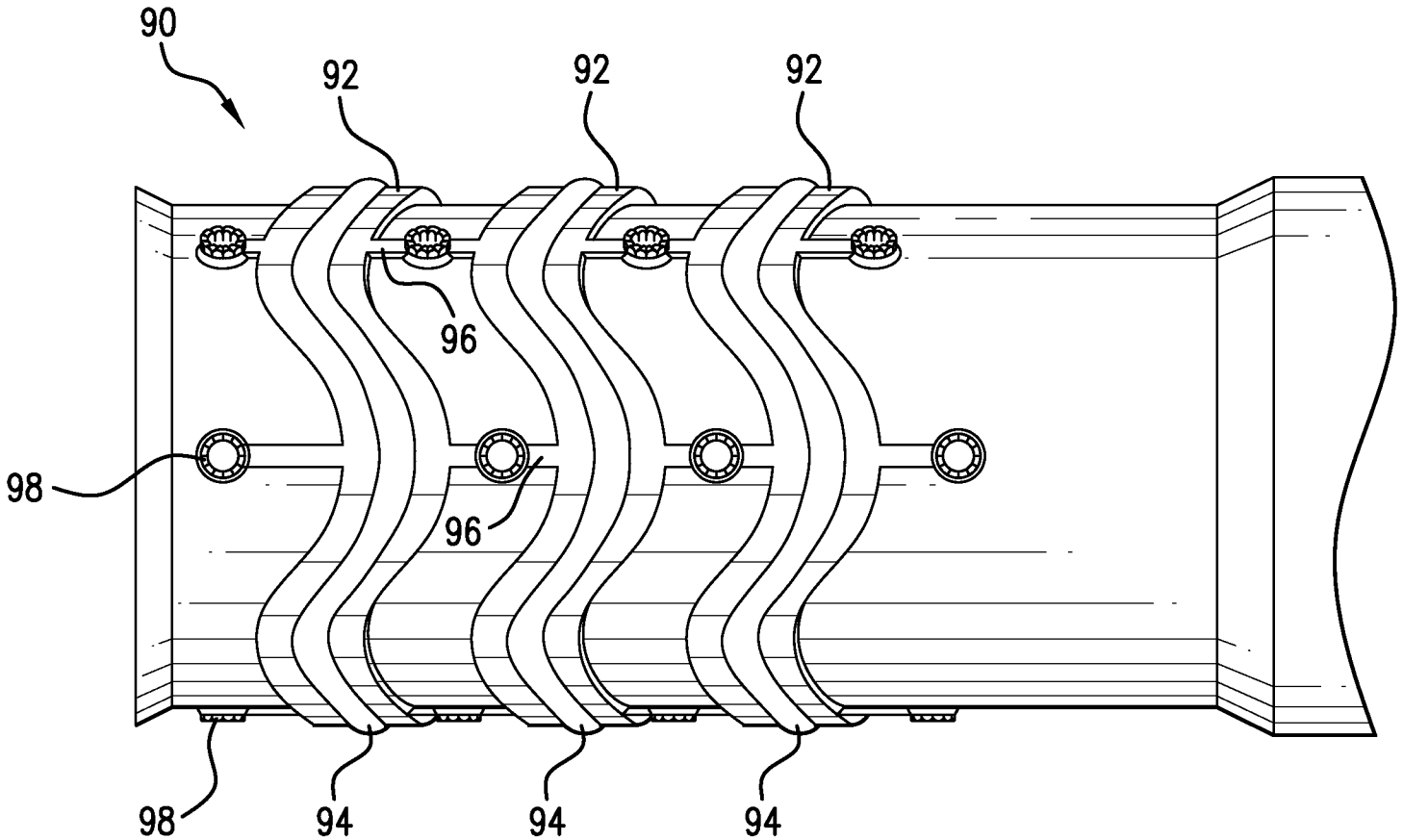
FIG. 8 shows a side plan view of another alternative exemplary embodiment of the liner hanger packer for the liner hanger assembly of FIG. 1.

As shown in FIG. 8, another exemplary embodiment of a wave seal packer 90 includes a plurality of wave portions 92 including seals 94 thereon. The wave portions 92 are spaced from each other but inter-connected together by axially extending connectors 96 so as to prevent their relative rotation. The connectors 96 may additionally include slips 98 as shown.

Figure 9:
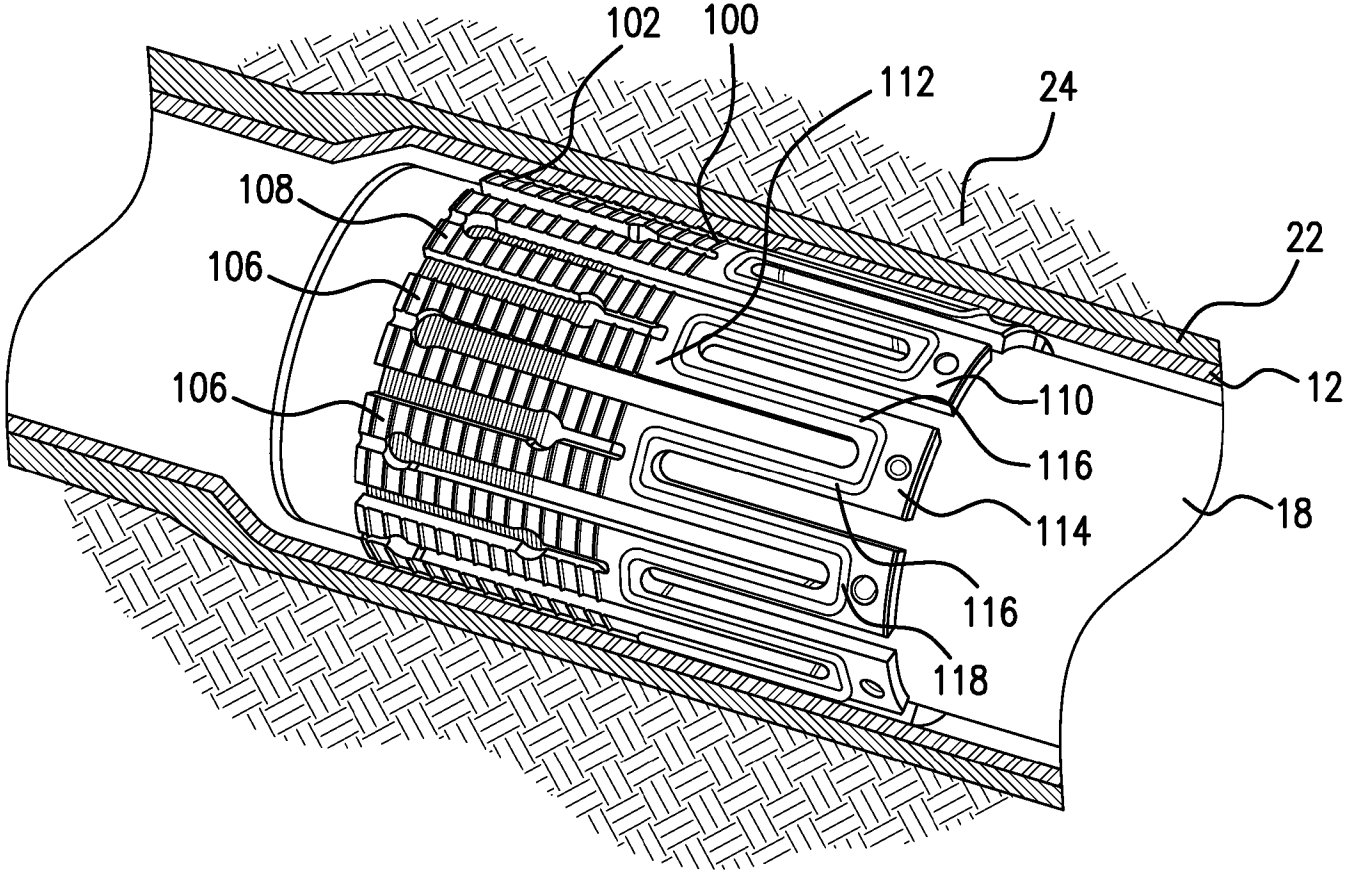
FIG. 9 shows a perspective view of a still another alternative exemplary embodiment of a liner hanger assembly within a cross-sectional view of a borehole casing; and, FIG. 10 shows a perspective view of yet another exemplary embodiment of a liner hanger assembly.

In another exemplary embodiment of a downhole assembly 100 shown in FIG. 9, the downhole assembly 100 is usable as a liner hanger assembly and includes a liner hanger 102 with a wave seal packer 104 integrated directly therewith. The liner hanger 102 includes a plurality of axially extending columns 106, each including a plurality of slips 108. Downhole of the slips 108, the liner hanger 102 integrally merges with a wave portion 110 of the packer 104. The wave portion 110 includes a plurality of alternating and interconnected uphole and downhole portions 112, 114. Although the wave portion 110 could be shaped as shown in FIGS. 1-2, the wave portion 110 of the liner hanger assembly 100 includes axially extending portions 116 interconnecting the uphole and downhole portions 112, 114, wherein the axially extending portions 116 are substantially parallel to each other. Each of the axially extending portions 116 of the wave portion 110 is integral with and in line with a column 106 of the liner hanger 102. Alternating adjacent pairs of columns 106 are connected at the uphole portions 112 of the wave portion 110 and alternating adjacent pairs of columns 106 are connected at the downhole portions 114 of the wave portion 110. FIG. 9 shows the liner hanger assembly 100 in an expanded condition, and it can be noted that the wave portion 110 does not expand to a circular shape as in the embodiment shown in FIG. 2. The wave portion 110 supports a continuous seal portion 118 thereon that extends in a waveform shape, such as by being disposed in a groove as previously described.

Figure 10:
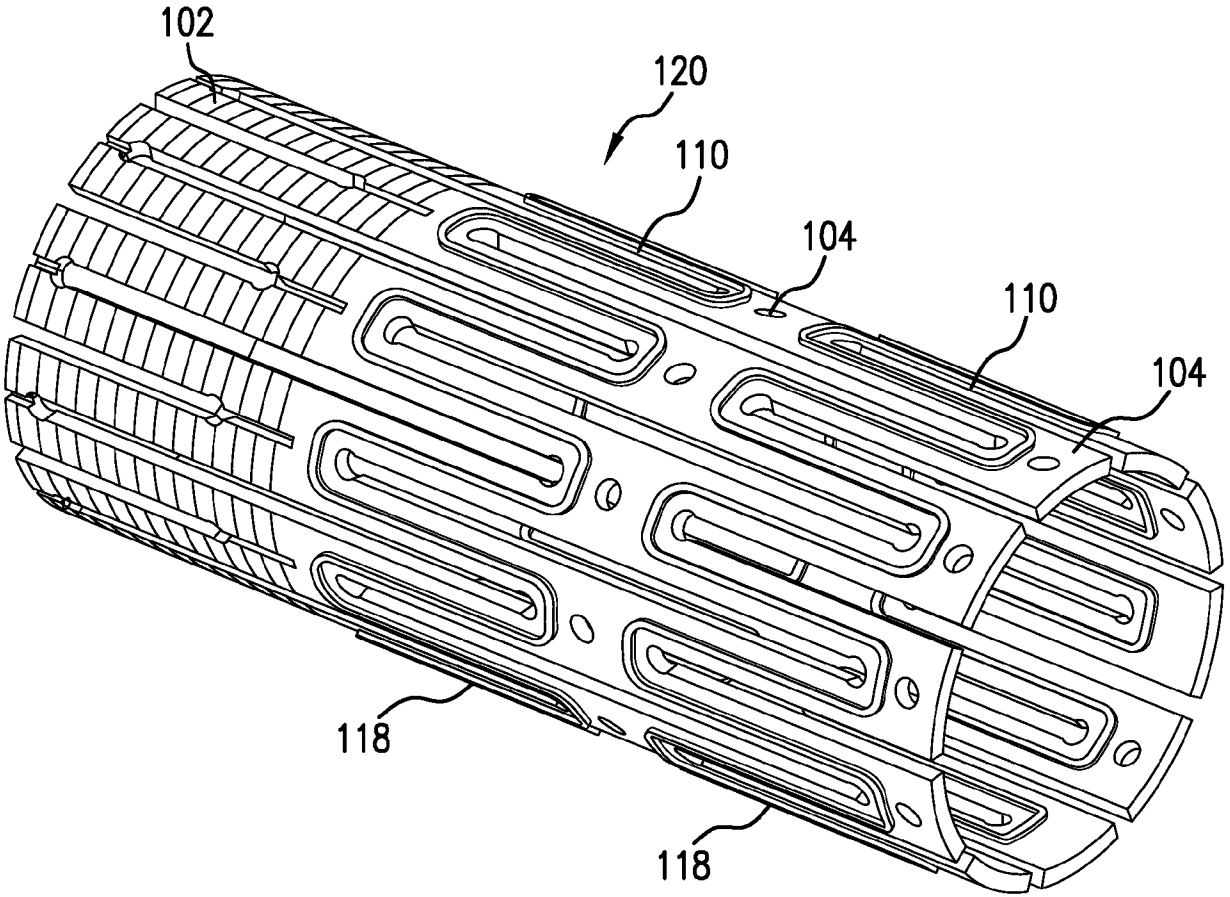

Another exemplary embodiment of a downhole assembly 120 shown in FIG. 10 is similar to the downhole assembly 100 of FIG. 9 except that a plurality of packers 104 are connected downhole of the liner hanger 102. In the illustrated embodiment, a first wave portion 110 is integrally connected downhole to the liner hanger 102, and a second wave portion 110 is integrally connected downhole to the first wave portion 110. Each wave portion 110 is provided with a seal portion 118. While two packers 104 are depicted, it should be understood that any number of packers 104 could be incorporated into the downhole assembly 120. Although the packers 104 shown in FIGS. 9 and 10 do not incorporate fingers 68 as shown in FIGS. 1-3, the integration of the packers 104 with the liner hanger 102 prohibit the wave packers 104 from rotating with respect to the liner hanger 102.

Thus, exemplary embodiments of a downhole assembly usable as a liner hanger assembly have been described that include a wave seal packer. By revising the geometry of a packer, the packer is able to have less plastic deformity while still delivering an increased rate of expansion. The liner hanger assembly is further designed to remove movement of the packer with respect to the liner hanger, and is usable as a high expansion rate hanger packer for monobore borehole constructions as well as other downhole applications.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole assembly comprising:

a wave seal packer including a wave portion having a wave form shape in an un-expanded condition, the wave portion configured to radially encircle a tubular with alternating and interconnected uphole and downhole portions, the packer having a substantially uniform internal radius in the un-expanded condition, the wave seal packer further including axially extending fingers connected to the wave portion and extending axially away from the wave portion with respect to a longitudinal axis of the downhole assembly; and, a liner hanger having a plurality of slips, wherein the packer is fixed relative to the liner hanger.

2. The downhole assembly of claim 1 wherein the wave portion includes a groove on an exterior surface thereof receptive to a sealing material.

3. The downhole assembly of claim 1 wherein a thickness of the packer in areas of the wave portion experiencing greater stress during expansion is higher than a thickness of the packer in areas experiencing less stress during expansion.

4. The downhole assembly of claim 1 wherein the wave portion of the packer has a wave shape with a reduced wave height in an expanded condition as compared to a wave height in the un-expanded condition.

5. The downhole assembly of claim 1 wherein the wave portion of the packer is substantially circular shaped in the expanded condition.

6. The downhole assembly of claim 1 wherein the wave portion includes substantially parallel axially extending portions interconnecting the uphole and downhole portions.

7. The downhole assembly of claim 6 wherein the liner hanger includes a plurality of columns supporting the slips thereon.

8. The downhole assembly of claim 1 further comprising the tubular, an interior surface of the packer including the uphole and downhole portions configured to lay substantially flush with the tubular in the un-expanded condition.

9. The downhole assembly of claim 1 wherein each of the uphole and downhole portions occupy a discrete radial section of the packer from each other.

10. The downhole assembly of claim 1 wherein the plurality of slips are arranged in axially extending columns, the fingers arranged between adjacent columns of the liner hanger.

11. The downhole assembly of claim 1 wherein the plurality of slips are arranged in axially extending columns, the packer integrally formed with the liner hanger.

12. The downhole assembly of claim 1 further comprising a plurality of the packers, wherein at least a portion of the liner hanger is interposed between the packers.

13. A downhole assembly comprising:

a tubular including a first portion made of a first material and a second portion made of a second material, the second portion having a lower expansion rate than the first portion;

a wave seal packer including a wave portion having a wave form shape in an un-expanded condition, the wave portion configured to radially encircle the tubular with alternating and interconnected uphole and downhole portions, the packer having a substantially uniform internal radius in the un-expanded condition; and, a liner hanger having a plurality of slips;

wherein the packer is fixed relative to the liner hanger, and the packer encircles the first portion of the tubular.

14. The downhole assembly of claim 13 wherein the first portion is welded to the second portion.

15. The downhole assembly of claim 13 wherein the tubular includes a third portion made of a third material, the third portion interposed between the first portion and the second portion, the third portion having a higher rate of expansion than the second portion and a lower rate of expansion than the first portion.

16. A downhole assembly comprising a wave seal packer, the wave seal packer including:

a wave portion having a wave form shape in an un-expanded condition, the wave portion configured to radially encircle a tubular with alternating and interconnected uphole and downhole portions; and, axially extending fingers integrally connected to and extending axially away from the wave portion with respect to a longitudinal axis of the downhole assembly;

wherein the packer has a substantially uniform internal radius in the un-expanded condition and in a fully expanded condition.

17. The downhole assembly of claim 16, wherein the fingers extend from the uphole portions of the packer and extend substantially parallel to each other with respect to the longitudinal axis of the downhole assembly.

18. The downhole assembly of claim 16, wherein the fingers include slips disposed thereon.

19. The downhole assembly of claim 16, wherein the wave portion includes a groove on an exterior surface thereof receptive to a sealing material.

20. The downhole assembly of claim 19, wherein the groove is offset from center within a width of the wave portion in areas of the wave portion experiencing greater stress during expansion as compared to areas of the wave portion experiencing lesser stress during expansion.

21. The downhole assembly of claim 16, wherein the axially extending fingers extend substantially parallel to the longitudinal axis in both the un-expanded condition and the expanded condition of the wave portion of the wave seal packer.

22. The downhole assembly of claim 16, wherein the uphole portions of the wave portion are disposed between the downhole portions of the wave portion and the axially extending fingers with respect to the longitudinal axis of the downhole assembly.

23. The downhole assembly of claim 16, wherein the axially extending fingers occupy a first longitudinal section of the downhole assembly with respect to the longitudinal axis, and the wave portion occupies a second longitudinal section of the downhole assembly with respect to the longitudinal axis, the second longitudinal section offset from the first longitudinal section with respect to the longitudinal axis.

* * * * *